US008002081B2

(12) United States Patent
Honma et al.

(10) Patent No.: US 8,002,081 B2
(45) Date of Patent: Aug. 23, 2011

(54) EXHAUST SYSTEM FOR COMBUSTION ENGINE

(75) Inventors: Shiro Honma, Kobe (JP); Jun Tanimoto, Kobe (JP); Takashi Maruyama, Akashi (JP); Yuji Takasugi, Kobe (JP); Tatsuya Yoshida, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 12/030,131

(22) Filed: Feb. 12, 2008

(65) Prior Publication Data

US 2008/0196970 A1 Aug. 21, 2008

(30) Foreign Application Priority Data

Feb. 16, 2007 (JP) ..... 2007-036483

(51) Int. Cl.
*F01N 1/10* (2006.01)

(52) U.S. Cl. ..... 181/256; 181/252; 181/258

(58) Field of Classification Search ..... 181/252, 181/256, 258, 247, 248, 249, 250, 255
See application file for complete search history.

(56) References Cited

U.S. PATENT DOCUMENTS

| | | | | | |
|---|---|---|---|---|---|
| 1,338,520 | A | * | 4/1920 | Moores | 181/253 |
| 1,876,861 | A | * | 9/1932 | Compo | 181/264 |
| 1,922,848 | A | * | 8/1933 | Harley | 181/264 |
| 2,523,260 | A | * | 9/1950 | Campbell | 181/256 |
| 3,263,772 | A | * | 8/1966 | Irwin et al. | 181/227 |
| 3,884,323 | A | * | 5/1975 | Kunz, Jr. | 181/247 |
| 4,064,961 | A | * | 12/1977 | Tseo | 181/213 |
| 4,076,099 | A | * | 2/1978 | Proksch | 181/264 |
| 4,220,219 | A | * | 9/1980 | Flugger | 181/265 |
| 4,226,298 | A | * | 10/1980 | Bancel et al. | 181/226 |
| 4,325,459 | A | * | 4/1982 | Martin | 181/248 |
| 4,371,053 | A | * | 2/1983 | Jones | 181/249 |
| 4,487,289 | A | * | 12/1984 | Kicinski et al. | 181/252 |
| 4,550,799 | A | * | 11/1985 | Flugger | 181/244 |
| 4,792,014 | A | * | 12/1988 | Shin-Seng | 181/280 |
| 4,809,812 | A | * | 3/1989 | Flugger | 181/268 |
| 4,842,096 | A | * | 6/1989 | Fujitsubo | 181/252 |
| 5,214,254 | A | * | 5/1993 | Sheehan | 181/241 |
| 5,371,331 | A | * | 12/1994 | Wall | 181/227 |
| 5,509,947 | A | * | 4/1996 | Burton | 96/383 |

(Continued)

FOREIGN PATENT DOCUMENTS

JP 52-48726 4/1977

(Continued)

OTHER PUBLICATIONS

Japanese Patent Application No. 2007-036483, Notification of Reasons for Rejection dated Jan. 11, 2011 w/English translation.

*Primary Examiner* — Jeremy Luks

(57) ABSTRACT

An exhaust system includes a tubular inner shell for passing therethrough exhaust gases from a combustion engine, and a tubular outer shell enclosing the tubular inner shell and cooperating therewith to define a sound silencing chamber into which the exhaust gases are introduced. The tubular inner shell forms an inner peripheral wall of the sound silencing chamber, and an upstream portion of the inner peripheral wall is formed with a perforated wall area having a plurality of communicating perforations for communicating between an interior of the tubular inner shell and the sound silencing chamber, and a downstream portion of the inner peripheral wall has a non-perforated wall area having no communicating perforation defined therein.

14 Claims, 6 Drawing Sheets

U.S. PATENT DOCUMENTS

| | | | | |
|---|---|---|---|---|
| 5,925,857 | A * | 7/1999 | Birkel et al. | 181/250 |
| 5,962,822 | A * | 10/1999 | May | 181/264 |
| 5,969,299 | A * | 10/1999 | Yamaguchi et al. | 181/227 |
| 6,082,487 | A * | 7/2000 | Angelo et al. | 181/256 |
| 6,520,285 | B2 * | 2/2003 | Tobias | 181/241 |
| 6,968,922 | B2 * | 11/2005 | Kawamata et al. | 181/231 |
| 2005/0161283 | A1 * | 7/2005 | Emler | 181/249 |

FOREIGN PATENT DOCUMENTS

| | | |
|---|---|---|
| JP | 54-020217 | 2/1979 |
| JP | 56-143309 | 9/1981 |
| JP | 08-312324 | 11/1996 |
| JP | 09-170432 | 6/1997 |
| JP | 2005-233167 | 9/2005 |

* cited by examiner

EXHAUST SYSTEM FOR COMBUSTION ENGINE

CROSS REFERENCE TO RELATED APPLICATIONS

This application is based on and claims priority to Japanese application No. 2007-036483 filed Feb. 16, 2007, which is incorporated by reference in its entirety into this application.

BACKGROUND OF THE INVENTION

1. Field of the Invention

The present invention relates to an automobile exhaust system for use in an automotive vehicle such as, for example, a motorcycle for substantially purifying exhaust gases emitted from a combustion engine of the automotive vehicle engine.

2. Description of the Prior Art

The Japanese Laid-open Patent Publication No. 08-312324, published Nov. 26, 1996, discloses a prior art exhaust system for a motorcycle combustion engine, of a kind to which the present invention pertains. The prior art exhaust system disclosed therein includes a generally cylindrical or tubular outer shell having a conical end cap secured to a downstream open end of the outer shell with respect to the direction of flow of exhaust gases from the combustion engine, and a generally cylindrical or tubular inner tubular shell disposed within the tubular outer shell in a fashion substantially coaxial therewith for the passage of the exhaust gases. A sound absorbing material such as, for example, glass wool having a multiplicity of interstices or open celled pores defined therein is filled in an annular chamber, which is delimited between the tubular outer and inner shell, so that the exhaust gases introduced from the combustion engine into the tubular inner shell can be subsequently introduced into the annular chamber between the tubular outer and inner shells through a plurality of communicating perforations defined in a circumferential wall of the tubular inner shell. The exhaust gases so introduced into the annular chamber flow through the interstices in the sound absorbing material with the consequence that exhaust noises can be attenuated.

This known exhaust system also includes a tailpipe having a diameter smaller than that of the tubular inner shell, which is disposed within the conical end cap in a fashion coaxially with the conical end cap so that the exhaust gases flowing through the tubular inner shell can be guided into the tailpipe to facilitate a further silencing of the exhaust noises.

Thus, the prior art exhaust system of a type discussed above makes use of two exhaust sound silencing means; a means of guiding the exhaust gases, introduced from the combustion engine into the tubular inner shell, into the sound absorbing material through the plural communicating perforations defined in the entire periphery of the tubular inner shell and a means of employing a reduced diameter of either the tubular inner shell or the tailpipe. However, it has been found that the use of those two means is still insufficient for an intended sound silencing effect. The sound silencing effect may be enhanced if the cross-sectional area of the tailpipe is reduced, but this may result in increase of the resistance to flow of the exhaust gases, which in turn results in reduction of the exhaust efficiency and hence, reduction in output of the combustion engine.

SUMMARY OF THE INVENTION

In view of the foregoing, the present invention has been devised to substantially eliminate the problems and inconveniences inherent in the prior art exhaust system and is intended to provide an exhaust system of a structure that is simple and inexpensive, but is effective to reduce the exhaust noise without incurring a reduction of the output of the combustion engine and, also, an increase of the weight thereof.

In order to accomplish the foregoing object and other objects, the present invention in one aspect thereof provides an exhaust system for a combustion engine, which includes a tubular inner shell for passage therethrough of exhaust gases from the combustion engine, and a tubular outer shell enclosing the tubular inner shell and cooperating with the tubular inner shell to define a sound silencing chamber between the tubular inner shell and the tubular outer shell for receiving the exhaust gases therein. The tubular inner shell has upstream and downstream portions with respect to the direction of flow of the exhaust gases from the combustion engine, and the upstream portion of the tubular inner shell has a perforated wall area defined therein with a plurality of communication perforations for communicating between an interior of the tubular inner shell and the sound silencing chamber. The downstream portion of the tubular inner shell has a non-perforated wall area defined therein with no communicating perforation.

In the conventional exhaust system, it has been generally considered that in order to secure a sound silencing effect by the introduction of exhaust gases into a sound absorbing material, it is optimum to form communicating perforations in the entire peripheral surface of the tubular inner shell. However, the present invention has successfully revoked such a general notion, and the non-perforated wall area is defined in the downstream portion of the tubular inner shell.

The use of the non-perforated wall area in the downstream portion of the tubular inner shell discussed above is indeed innovative in that the exhaust gases entering into the sound silencing chamber through the communicating perforations defined in the upstream portion of the tubular inner shell can, when reaching a downstream portion of the sound silencing chamber, be confined on an outer periphery of the non-perforated wall area of the tubular inner shell in the sound silencing chamber. As a result, in addition to attenuation of the exhaust noises resulting from contraction and expansion, which the exhaust gases undergo as they flow into the sound silencing chamber through the perforated wall area in the tubular inner shell, the exhaust noises can be effectively reduced by the effect of suppression of the turbulence of the exhaust pressure and sound muffling inside the non-perforated wall area of the tubular inner shell. Moreover, since there is no need to constrict the cross-sectional area of the tubular inner shell, no reduction in output of the combustion engine occurs. Also, since a mere change of the downstream portion of the tubular inner shell to have the non-perforated wall area is sufficient, the structure can be manufactured simply and inexpensively without incurring any increase in weight.

The sound silencing chamber may have a sound absorbing material disposed therein. The use of the sound absorbing material within the sound silencing chamber is effective to enhance the sound absorbing effect in combination with a further sound muffling to thereby further reduce the exhaust noises.

In one preferred embodiment of the present invention, the non-perforated wall area of the tubular inner shell preferably has an axial length with respect to the direction of flow of the exhaust gases, which is equal to or greater than 1.3 times the inner diameter of the non-perforated wall area of the tubular inner shell, but smaller than the axial length of the perforated wall area thereof with respect to the direction of flow of the exhaust gases. The use of the perforated wall area, which is shorter than the non-perforated wall area, is effective to maintain the effect of reducing the exhaust noises achieved by the sound absorbing material, while the use of the non-perforated wall area, which has an axial length equal to or greater than 1.3 times the effective inner diameter of the tubular inner shell, is effective to attenuate the exhaust noises by muffling the exhaust sounds sufficiently, resulting in increase of the sound silencing effect.

In the practice of the present invention, the axial length of the non-perforated wall area of the tubular inner shell is preferably set to be within the range of 1.3 to 5 times the inner diameter thereof and within the range of 0.20 to 0.90 times the axial length of the perforated wall area.

It is to be noted that the term, "axial length" referred to above and hereinafter used in connection with the tubular inner shell is intended to mean the length as measured along the longitudinal axis of the tubular inner shell.

In another preferred embodiment of the present invention, an exhaust gas pressure regulating member that is tapered in a direction upstream thereof with respect to the direction of flow of the exhaust gases is disposed inside the non-perforated wall area of the tubular inner shell.

According to the above preferred structural feature, since the exhaust gases flowing inside the tubular inner shell and reaching the non-perforated wall area within the tubular inner shell can be guided in their entire quantity to flow, while being dispersed along the exhaust gas pressure regulating member of a shape tapered in the upstream direction thereof while being dispersed in a radially outward direction, so as to impinge upon an inner peripheral surface of the tubular inner shell because of the absence of any communicating perforation in that wall area of the tubular inner shell. Accordingly, the exhaust gas pressure changes as the exhaust gases flow through an annular gap between the exhaust gas pressure regulating member and the tubular inner shell and, in turn, the sound silencing effect can be obtained. In such case, the exhaust gases flow smoothly within an annular exhaust passageway having a large cross-sectional area between the exhaust gas pressure regulating member and the tubular inner shell and along the exhaust gas pressure regulating member of a tapered shape. Accordingly, as compared with the case in which the cross-sectional area of the exhaust gas passageway is abruptly reduced with the inner diameter of the tailpipe reduced, the resistance to flow of the exhaust gases is low enough to minimize any undesirable reduction in output of the combustion engine.

In a further preferred embodiment of the present invention, the exhaust gas pressure regulating member referred to above may be of a conical shape. The use of such conical shape member is effective to further smoothly guide the exhaust gases towards the inner peripheral surface of the tubular inner shell while being uniformly dispersed in the radially outward direction along the conical exhaust gas pressure regulating member. Preferably, the conical shape of the exhaust gas pressure regulating member has a half apex angle set to be within the range of, for example, 3 to 20°. The term "half apex angle" referred to above and hereinafter means the apex angle divided equally by two.

The exhaust gas pressure regulating member referred to above may be comprised of a pair of cone halves, which substantially correspond to respective halves of the shape of a cone divided by a plane including an axis of the cone, and which are flanged. Such cone halves are connected together to define the conical exhaust gas pressure regulating member. The conical exhaust gas pressure regulating member so flanged have opposite, mutually connected flanges rigidly secured to respective portions of the inner peripheral surface of the tubular inner shell. The use of the pair of the cone halves is effective to facilitate manufacture of the exhaust gas pressure regulating member and also to allow it to be securely supported by the tubular inner shell.

In a still further preferred embodiment of the present invention, the exhaust gas pressure regulating member referred to above has an upstream end with respect to the direction of flow of the exhaust gases and may be of a construction including an inner passageway for the passage of the exhaust gases from the upstream end thereof in a direction along the longitudinal axis of the tubular inner shell, and a plurality of cutouts defined in a downstream portion of the exhaust gas pressure regulating member for introducing portions of the exhaust gases, which have passed through an annular gap delimited between the tapered outer peripheral surface and the inner peripheral surface of the tubular inner shell, into the inner passageway.

This preferred construction is effective to allow those portions of the exhaust gases reaching the non-perforated wall area of the tubular inner shell to be guided so as to impinge upon the inner peripheral surface of the tubular inner shell while being dispersed in a radially outward direction along the tapered outer peripheral surface, and to allow the remaining portions of the exhaust gases to flow straight through the inner passageway. The remaining portions of the exhaust gases flowing straight through the inner passageway brings about a negative pressure inside the inner passageway by an ejector effect. Because of such ejector effect, those portions of the exhaust gases flowing in the annular exhaust passageway between the exhaust gas pressure regulating member and the tubular inner shell can be smoothly introduced into the inner passageway through the cutout in the downstream portion of the exhaust gas pressure regulating member.

The sound silencing effect can be obtained when the pressure of the exhaust gases is changed as they flow towards the cutout through the gap or the annular exhaust passageway between the outer peripheral surface and the tubular inner shell. Also, the exhaust gases introduced into such gap can be sucked by the ejector effect so as to flow towards the inner passageway smoothly through the cutout in the downstream portion of the exhaust gas pressure regulating member and, accordingly, an undesirable increase of the flow resistance of the exhaust gases can be suppressed to minimize the reduction in output of the combustion engine.

The exhaust gas pressure regulating member referred to above may include a tubular outer element having a tapered shape and a tubular inner element of a substantially cylindrical shape, positioned inside the tubular outer element, for passing therethrough the exhaust gases. This is particularly advantageous in that the exhaust gas pressure regulating member can have a simplified structure including only two tubular elements.

Also, the cutout referred to above is preferably defined in a downstream portion of the tubular outer element so as to extend from a downstream end towards an upstream side. This cutout may have a length as measured along a longitudinal axis of the tubular outer element, in a direction conforming to the direction of flow of the exhaust gases, which is set to be preferably within the range of ⅓ to ½ of the length of the tubular outer element, so that the sound silencing effect can be enhanced.

Preferably, the exhaust gas pressure regulating member may be made up of a straight tube portion forming a front half portion thereof, and a tapered tube portion forming a rear half portion thereof.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Hereinafter, the present invention will be described in detail in connection with some preferred embodiments thereof with reference to the accompanying drawings. Before the detailed description of the preferred embodiments of the present invention proceeds, it is to be noted that the terms "upstream" and "downstream" used hereinbefore and hereinafter are a relative term used with respect to the direction of flow of exhaust gases from an engine toward the atmosphere.

Figure 7:
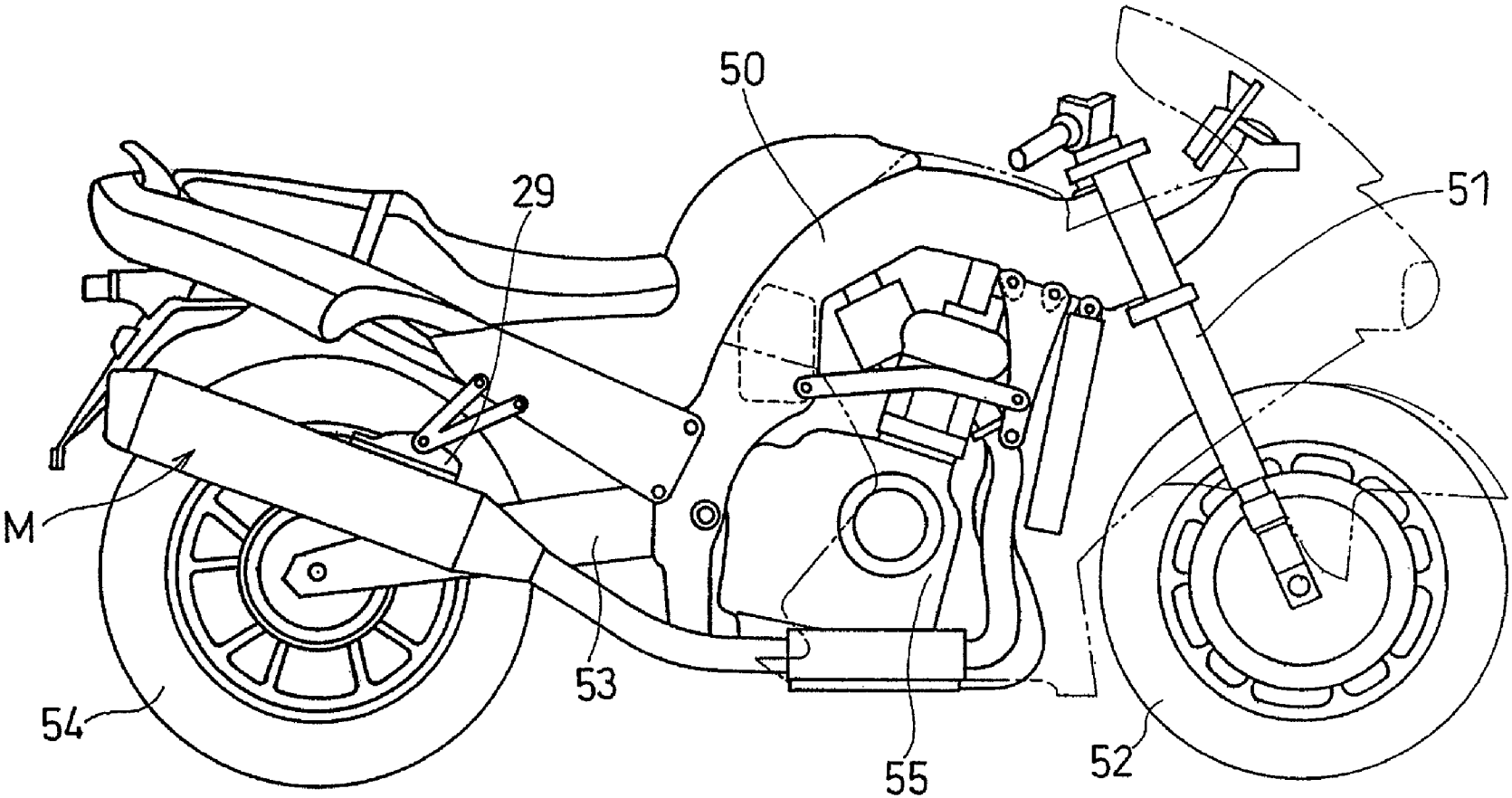
FIG. 7 is a schematic side view showing a motorcycle on which the exhaust system of the present invention can be employed.

An exhaust system M of the present invention, which will be described in detail subsequently, can be employed in association with a combustion engine mounted on, for example, a motorcycle as best shown in FIG. 7. Referring first to FIG. 7, the motorcycle shown therein may be of a structure including a motorcycle frame structure 50, a front fork 51 pivotally mounted on a front frame portion of the motorcycle frame structure 50, and a front wheel 52 rotatably supported by the front fork 51. A swingarm 53 is mounted on a generally intermediate frame portion of the motorcycle frame structure 50 for pivotal movement up and down, and a rear drive wheel 54 is rotatably supported by the swingarm 53 in any manner know to those skilled in the art and is drivingly coupled with a motorcycle engine 55 that is mounted on the generally intermediate portion of the motorcycle frame structure 50. The exhaust system M referred to above is disposed laterally of the rear drive wheel 54 and mounted on and steadily supported by a rear portion of the motorcycle frame structure 50 in a manner also known to those skilled in the art.

Figure 1:
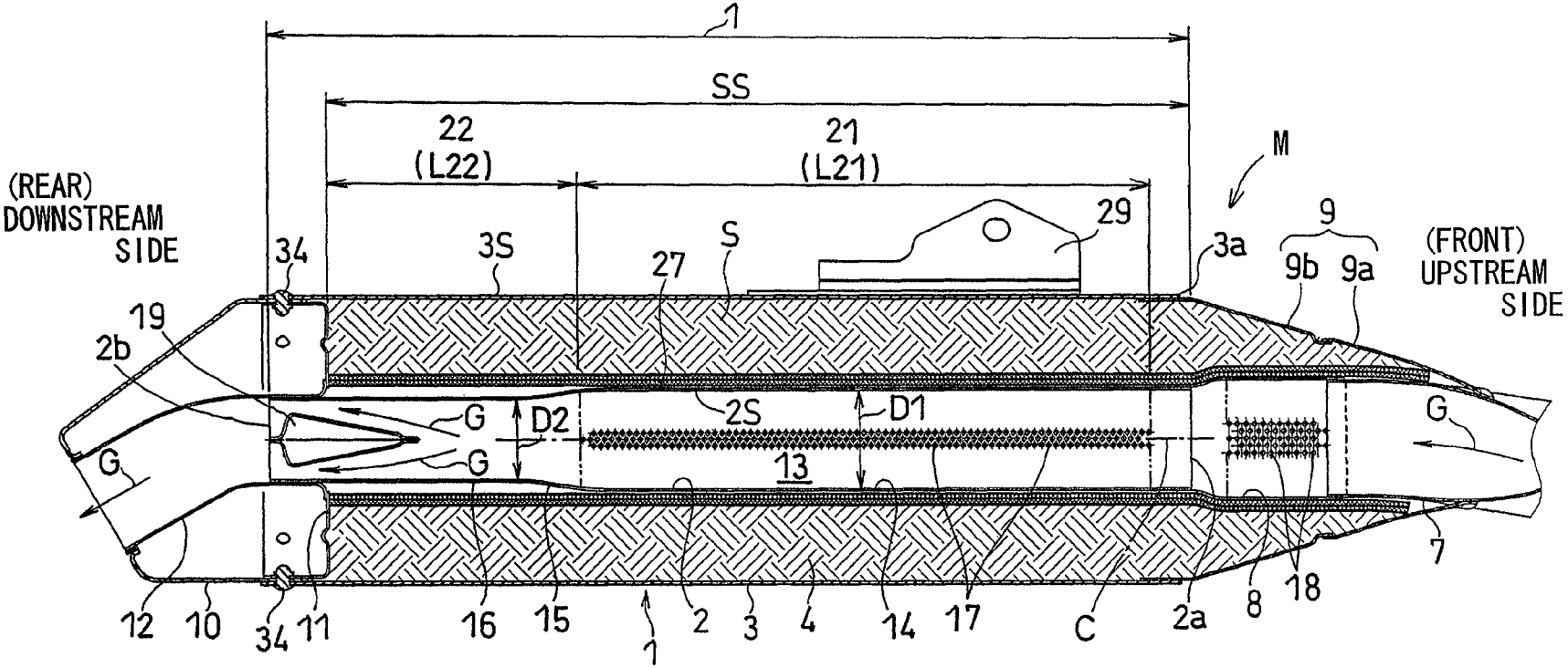
FIG. 1 is a longitudinal sectional view showing an exhaust system according to a preferred embodiment of the present invention.

The details of the exhaust system M according to a first preferred embodiment of the present invention is best shown in FIG. 1 showing a longitudinal sectional view thereof. As shown in FIG. 1, this exhaust system M is of a type designed for use in, for example, a motorcycle and has an emission control unit 1 which includes a tubular inner shell 2, through which exhaust gases G emitted from a motorcycle engine 55 shown in FIG. 7 flows, a tubular outer shell 3 enclosing the tubular inner shell 2 and disposed outside the tubular inner shell 2 in a fashion substantially or generally coaxial therewith, and a sound absorbing material 4 filling an annular chamber forming a sound silencing chamber S, which is delimited between the tubular inner and outer shells 2 and 3. The emission control unit 1 is defined and positioned substantially intermediate between a front or upstream end 2*a* of the tubular inner shell 2 and a rear or downstream end 2*b* of the tubular inner shell 2.

The tubular outer shell 3 is made of, for example, an aluminum alloy and is in the form of a tubular body of an oval cross-sectional shape having a major axis lying in a direction generally perpendicular thereto. Alternatively, the tubular body forming the tubular outer shell 3 may have any suitable cross-sectional shape, which is elliptical, triangular, square, polygonal or round. On the other hand, the tubular inner shell 2 is made of, for example, iron and includes a large diameter tube portion 14 in the form of a cylindrical tube having a large inner diameter D1 and a reduced diameter tube portion 16 in the form of a cylindrical tube having a small inner diameter D2 and positioned downstream of and communicated with the large diameter tube portion 14 through a tapered tube portion 15. The large diameter tube portion 14 and the tapered tube portion 15 are formed with a plurality of small communicating perforations 17 defined therein through which the interior of the tubular inner shell 2 communicates with the sound silencing chamber S delimited between the tubular inner and outer shells 2 and 3.

The large diameter tube portion 14, the tapered tube portion 15 and the reduced diameter tube portion 16 are held in coaxial relation to each other and, accordingly, the tubular inner shell 2 has a single longitudinal axis indicated by C. It is, however, to be noted that the tubular inner shell 2 may have a large inner diameter D1 substantially or generally uniformly over the entire length thereof without being constricted and that even though the tubular inner shell of a generally uniform inner diameter over the entire length thereof is employed, the sound silencing effect afforded thereby makes no difference with the tubular inner shell 2 of the structure shown and described with reference to FIG. 1.

An exhaust tube 7 made of iron is fluidly connected with the front or upstream end portion of the tubular inner shell 2 through a connecting tube 8, made of iron, so that the exhaust gases G emitted from the motorcycle engine can be introduced therethrough into the emission control unit 1. The upstream end portion of the tubular inner shell 2 and a rear or downstream end portion of the exhaust tube 7 made of iron are welded to an inner peripheral surface of the connecting tube 8 in a fashion inserted into respective opposite ends of the connecting tube 8.

A front or upstream end portion of the tubular outer shell 3 and the exhaust tube 7 are connected with each other through a tapered tube portion 9 made of iron enclosing the connecting tube 8. The tapered tube portion 9 is of two-piece construction including longitudinal halves, i.e., a front half portion 9*a* and a rear half portion 9*b*. The front half portion 9*a* of the tapered tube portion 9 has a front end portion mounted around and welded to the exhaust tube 7, whereas the rear half portion 9*b* thereof has a rear end portion inserted into and bolted to an inner peripheral surface of the tubular outer shell 3 through a sealing material.

On the other hand, the tubular outer shell 3 has a rear or downstream end portion with which a tail end shell 10 is connected together with an annular end plate 11 by means of a plurality of rivets 34, and a tailpipe 12 is supported by the tail end shell 10 and the annular end plate 11. The tailpipe 12 has a front or upstream end portion welded to an inner end of the end plate 11 and a rear or downstream end portion mounted around a rear open portion of the tail end shell 10 through a sealing member. The rear or downstream end portion of the tubular inner shell 2 referred to above, particularly the downstream end portion of the reduced diameter tube portion 16 of the tubular inner shell 2, is inserted into the front or upstream end portion of the tailpipe 12.

Thus, the exhaust system M of the structure described above includes the connecting tube 8, the tubular inner shell 2 and the tailpipe 12 all cooperating to define an exhaust passage 13 through which the exhaust gases G emitted from the motorcycle engine and subsequently introduced thereinto through the exhaust tube 7 can be discharged to the atmosphere.

The sound absorbing material 4 filling the sound silencing chamber S delimited between the tubular inner and outer shells 2 and 3 is employed in the form of fibrous material such as, for example, glass wool or steel wool. The sound silencing chamber S is a sealed chamber confined by the tubular inner shell 2, the connecting tube 8, the tubular outer shell 3, the tapered tube portion 9 and the end plate 11. A retaining member 27 formed by weaving a stainless wool material and a ferrous wire cloth material together intervenes between the outer peripheral surface of the tubular inner shell 2 and the sound absorbing material 4 in a fashion double wound therearound, to thereby prevent portions of the sound absorbing material 4 from intruding into the tubular inner shell 2 through some or all of the communicating perforations 17. Also, the outer peripheral surface of the tubular outer shell 3 is provided with a bracket 29, through which the exhaust system M can be rigidly secured to a motorcycle frame structure.

The sound silencing chamber S delimited between the tubular inner and outer shells 2 and 3 extends over a region SS from the upstream end 2*a* of the tubular inner shell 2 to the end plate 11. Accordingly, a major portion of the tubular inner shell 2 forms an inner peripheral wall 2S of the sound silencing chamber S whereas a major portion of the tubular outer shell 3 forms an outer peripheral wall 3S of the sound silencing chamber S. The tubular outer shell 3 has a front or upstream end 3*a* positioned substantially in flush with the front or upstream end 2*a* of the tubular inner shell 2. An upstream portion of the inner peripheral wall 2S of the sound silencing chamber S has a perforated wall area 21 defined therein, with the communicating perforations 17 defined in such perforated wall area 21. The perforated wall area 21 referred to above lies over an axial range extending from a position somewhat downwardly of the upstream end 2*a* of the tubular inner shell 2 to a portion of the tapered tube portion 15 past a rear or downstream end of the large diameter tube portion 14. On the other hand, a downstream portion of the perforated wall area 21 in the inner peripheral wall 2S of the sound silencing chamber S, that is, an region ranging from the downstream end of the perforated wall area 21 in the tapered tube portion 15 to the major portion of the reduced diameter tube portion 16 is rendered to be a non-perforated wall area 22 with no communicating perforations 17 defined therein.

A major portion of the connecting tube 8 is also formed with a multiplicity of communicating perforations 18 that extend completely across a wall defining the connecting tube 8, that is, that communicate between the inside and outside of the connecting tube 8, thereby enhancing the sound silencing effect afforded by the sound silencing material 4. Although in the embodiment now under discussion, the non-perforated wall area 22 in the inner peripheral wall 2S has an axial length L22 which is about 2.8 times the inner diameter D2 of this non-perforated wall area 22 and about 0.45 times the axial length L21 of the perforated wall area 21 thereof, the axial length L22 of the non-perforated wall area 22 may be preferably equal to or greater than 1.3 times the inner diameter D2 of the non-perforated wall area 22, and smaller than the axial length L21 of the perforated wall area 21 for the reason which will be described later.

An exhaust gas pressure regulating member 19 of a configuration tapering towards an upstream side, which in the illustrated embodiment represents a substantially conical shape, is disposed inside the non-perforated wall area 22 of the inner shell 2 in a fashion aligned with the longitudinal axis C of the tubular inner shell 2, with an annular gap defined between it and the inner peripheral surface of the tubular inner shell 2. This exhaust gas pressure regulating member 19 is of a structure which is shown and will now be described with particular reference to FIGS. 2A to 2C.

Figure 2A:
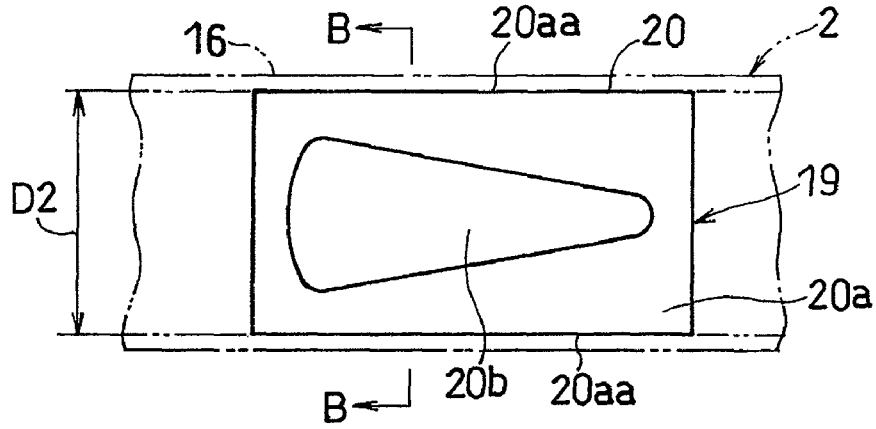
FIG. 2A is a plan view showing an exhaust gas pressure regulating member employed in the exhaust system.
Figure 2B:
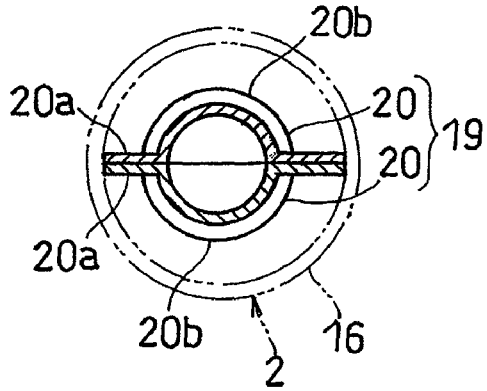
FIG. 2B is a cross-sectional view taken along the line B-B in FIG. 2A.
Figure 2C:
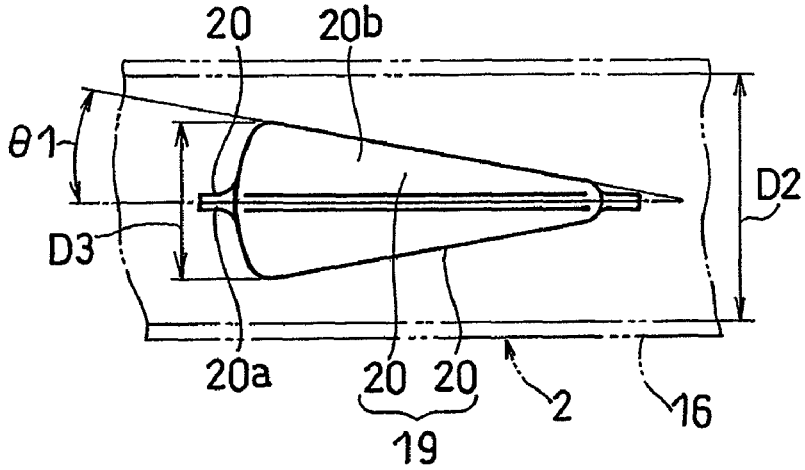
FIG. 2C is a side view of the exhaust gas pressure regulating member.

FIG. 2A illustrates a plan view of the exhaust gas pressure regulating member 19, FIG. 2B illustrates a cross-sectional view taken along the line B-B in FIG. 2A and FIG. 2C illustrates a side view of the exhaust gas pressure regulating member 19. As shown therein, the exhaust gas pressure regulating member 19 is of a structure including a pair of cone halves 20 and 20 of a substantially identical construction joined together to represent the conical shape. To facilitate manufacturing, each of the cone halves 20 and 20 is formed as a substantially rectangular metallic plate by forming a conical bulged portion 20*b* while leaving a peripheral flange 20*a* on the periphery of that bulged portion 20*b*. Each of the pair of conical bulged portion 20*b* is of a generally longitudinally halved-conical shape, divided by a plane containing a center thereof conforming the longitudinal axis C of the tubular inner shell 2, so that when the cone halves 20 and 20 are rigidly connected together with the peripheral flanges 20*a* and 20*a* joined together in overlapped relation, the respective bulged portions 20*b* and 20*b* cooperate to represent a complete conical shape.

The peripheral flange 20*a* of each of the cone halves 20 is formed to represent a substantially rectangular configuration having opposite short sides of a length substantially equal to the inner diameter D2 of the reduced diameter tube portion 16 of the tubular inner shell 2. Accordingly, the exhaust gas pressure regulating member 19 is fitted inside the reduced diameter tube portion 16 with opposite long sides 20*aa* and 20*aa* of the mutually overlapped peripheral flanges 20*a* and 20*a* abutted and welded to respective portions of an inner peripheral surface of the reduced diameter tube portion 16, thereby allowing the exhaust gas pressure regulating member 19 to be firmly supported inside the tubular inner shell 2.

It is, however, to be noted that the exhaust gas pressure regulating member 19 may not be always manufactured in the manner described above, but may be unitarily formed by the use of any known method such as bulging process.

The operation of the exhaust system M of the structure described above in accordance with the present invention will now be described. The exhaust gases G introduced from the motorcycle engine 55 (FIG. 7) into the emission control unit 1 through the exhaust tube 7 by way of the connecting tube 8 flow in part into the sound silencing chamber S through the plural communicating perforations 17 defined in the perforated wall area 21 of the tubular inner shell 2 and the remaining portion of the exhaust gases G flows straight through the tubular inner shell 2. As that portion of the exhaust gases flows into the sound silencing chamber S through the communicating perforations 17 undergoes expansion and contraction with the exhaust noises reduced consequently. At the same time, the exhaust noises are absorbed by the sound absorbing material 4 within the sound silencing chamber S and are accordingly attenuated.

In addition, the exhaust gases G within the sound silencing chamber S subsequently further flow towards the outside of the non-perforated wall area 22 at a location downstream of the tubular inner shell 2. However, since the exhaust gases G arriving at the outside of the non-perforated wall area 22 are unable to flow into the inside of the non-perforated wall area 22 because of the absence of any communicating perforation in the non-perforated wall area 22, the exhaust gases G outside the non-perforated wall area 22 are confined within the sound silencing material 4. Accordingly, any turbulence of the exhaust pressure can be suppressed and exhaust noises brought about by the exhaust gases G can be confined within the sound silencing material 4, with the exhaust noises cut off consequently. In this way, the exhaust noises can be effectively reduced.

Also, since the cross-sectional area of the tubular inner shell 2 need not be constricted, reduction of the output of the motorcycle engine with reduction in exhaust efficiency can be prevented. Moreover, the structure can be simplified and manufactured inexpensively without accompanying any increase in weight since the exhaust system M is obtained merely by forming the non-perforated wall area 22 in that downstream portion of the tubular inner shell 2 within the sound silencing chamber S.

A series of experiments conducted make it certain that when the axial length L2 of the non-perforated wall area 22 formed downstream of the perforated wall area 21 of the tubular inner shell 2 shown in FIG. 1, as measured in a direction along the longitudinal axis C of the tubular inner shell 2 is set to be equal to or greater than 1.3 times the inner diameter D2 of the reduced diameter tube portion 16 and shorter than the axial length L21 of the perforated wall area 21, the level of the exhaust noises resulting from the exhaust gases G is lowered by 1 to 1.5 dB, as compared with the conventional exhaust system employing the tubular inner shell having a perforated wall area over the substantially entire length thereof, and no reduction in output of the motorcycle engine is observed.

When the axial length L22 of the non-perforated wall area 22 is set to be smaller than 1.3 times the inner diameter D2 of the non-perforated wall area 22, the sound silencing effect, by which the exhaust noises can be cut off with the exhaust noises confined by means of the non-perforated wall area 22, cannot be obtained sufficiently. Also, if the axial length L22 of the non-perforated wall area 22 is set to be greater than the axial length L21 of the perforated wall area 21, for a given overall length of the emission control unit 1 the length of the perforated wall area 21 becomes insufficient and, accordingly, the sound silencing chamber S and the sound absorbing material 4 have an insufficient capacity, with the sound silencing effect reduced consequently.

The non-perforated wall area 22 has an axial length L22, which is set to be more preferably within the range of 1.3 to 5.0 times the inner diameter D2 of the reduced diameter tube portion 16 and also within the range of 0.20 to 0.90 times the axial length L21 of the reduced diameter tube portion 16. When the axial length L22 of the non-perforated wall area 22 exceeds a value equal to 5.0 times the inner diameter D2 of the reduced diameter tube portion 16, the necessity will arise to increase the axial length L21 of the perforated wall area 21 correspondingly and, hence, to increase the axial length of the tubular inner shell 2, resulting in increase of the size of the exhaust system M as a whole. Conversely, when the axial length L22 of the non-perforated wall area 22 is of a value smaller than 0.20 times the axial length L21 of the perforated wall area 21, difficulty will arise to secure the length that is greater than 1.3 times the inner diameter D2 of the reduced diameter tube portion 16.

Furthermore preferably, the axial length L22 of the non-perforated wall area 22 is set to be within the range of 1.5 to 4.0 times the inner diameter D2 of the reduced diameter tube portion 16 and, also, within the range of 0.35 to 0.70 times the axial length L21 of the perforated wall area 21.

When respective portions of the exhaust gases G, which flows straight within the tubular inner shell 2 and which flows from the sound silencing material 4 backwards into the tubular inner shell 2 through the communicating perforations 17 reach the non-perforated wall area 22 in the tubular inner shell 2, all of them can be guided to flow along the bulged portions 20*b* and 20*b* of the exhaust gas pressure regulating member 19 of a shape tapered in the upstream direction thereof while substantially uniformly dispersing in a radial direction so as to impinge upon the inner peripheral surface of the tubular inner shell 2 because of the absence of any communicating perforation in the non-perforated wall area 22. Since the exhaust gases G in their entire quantity flow through the annular exhaust passage 13 delimited between the pressure regulator body, defined by the bulged portions 20*b* and 20*b* joined together, and the inner peripheral surface of the tubular inner shell 2 in that way, the exhaust pressure undergoes a change (i.e., increases somewhat in the illustrated embodiment) to provide a sound silencing effect. According to the result of the experiments conducted, where the pressure regulator body of the exhaust gas pressure regulating member 19, which is defined by the bulged portions 20*b* and 20*b* joined together, has a maximum outer diameter D3 as shown in FIG. 2C, which is of a value equal to about 0.7 times the inner diameter D2 of the non-perforated wall area 22 and also has a half apex angle θ1 of 10°, as compared with the case in which no non-perforated wall area corresponding to the non-perforated wall area 22 is employed, not only can the exhaust sounds be reduced by a level of 1 to 1.5 dB, but it has ascertained that the exhaust noises could be reduced by a level of about 1.0 dB.

In addition, the exhaust gases G flowing through the non-perforated wall area 22 in the tubular inner shell 2, while being guided by the respective bulged portions 20*b*, 20*b* of the exhaust gas pressure regulating member 19, smoothly flow through the annular exhaust passage 13 delimited between the bulged portions 20*b*, 20*b* and the tubular inner shell 2 and having a relatively large cross-sectional area. Accordingly, the flow resistance to the exhaust gases G will not increase so much, as compared with the case in which the tailpipe 12 shown in FIG. 1 has its inner diameter reduced to abruptly reduce the cross-sectional area of the exhaust passage, thereby minimizing the reduction of the output of the motorcycle engine, particularly, that at low and medium speed ranges.

As hereinabove described, according to the present invention, the provision of the non-perforated wall area 22 and the exhaust gas pressure regulating member 19 of a conical shape is effective to provide a considerable sound silencing effect while any undesirable reduction of the output of the motorcycle engine is suppressed, and, therefore, for a given sound silencing effect and an engine output the emission control unit 1 can have a reduced capacity and, also, a reduced length.

According to the present invention, the above described sound silencing effect can be equally obtained even when the exhaust gas pressure regulating member 19 is disposed anywhere within the non-perforated wall area 22 in the tubular inner shell 2. Also, as shown in FIG. 2C, the conical shape defined by the bulged portions 20*b* and 20*b* joined together, has a half apex angle θ1, which is set to be preferably within the range of 3 to 20°. This is because, when the half apex angle θ1 is set to be smaller than the lower limit of 3°, the sound silencing effect will almost diminish, while when the half apex angle θ1 exceeds the upper limit of 20°, the flow resistance to the exhaust gases G will increase enough to result in reduction in output of the motorcycle engine.

It is to be noted that the shape represented by the bulged portions 20*b* and 20*b* may not be always limited to a conical shape such as employed in the foregoing embodiment of the present invention, but may be any suitable pyramidal shape.

Figure 3:
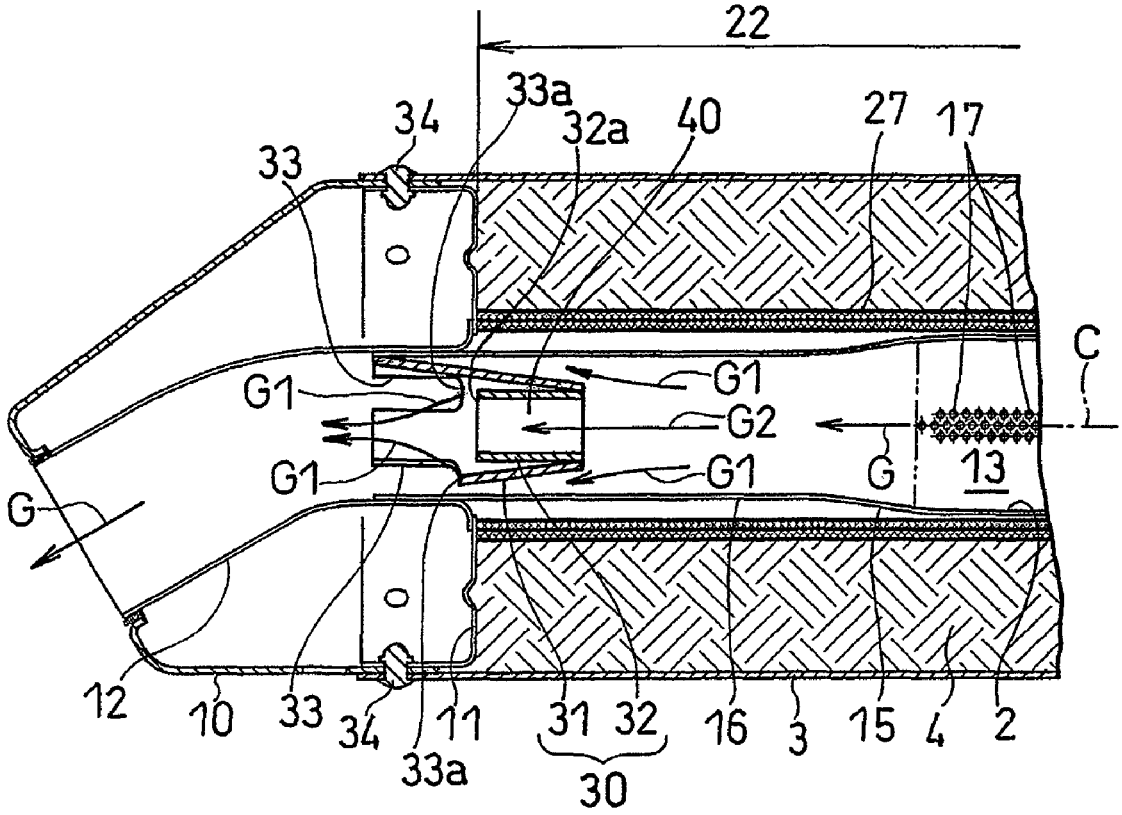
FIG. 3 is a fragmentary longitudinal sectional view showing an essential portion of the exhaust system according to a second preferred embodiment of the present invention.

FIG. 3 illustrates a fragmentary longitudinal sectional view showing an essential portion of the exhaust system M according to a second preferred embodiment of the present invention. The exhaust system M according to this embodiment is substantially similar to that according to the foregoing embodiment, but differs therefrom in respect of the details of the exhaust gas pressure regulating member 19.

More specifically, in the embodiment shown in FIG. 3, in place of the conical exhaust gas pressure regulating member 19 employed in the previously described embodiment, an exhaust gas pressure regulating member 30 is employed, which includes a tubular outer element 31 having a tapered shape and a tubular inner element 32 of a substantially cylindrical shape connected coaxially with and positioned inside the tubular outer element 31 for passing therethrough the exhaust gases G. The tubular inner element 32 defines a major portion of an inner passageway 40 inside the exhaust gas pressure regulating member 30 so as to extend over the entire length thereof and is utilized to allow the exhaust gases G to flow from an upstream end portion thereof in a direction along the longitudinal axis of the tubular inner shell 2.

Figure 4:
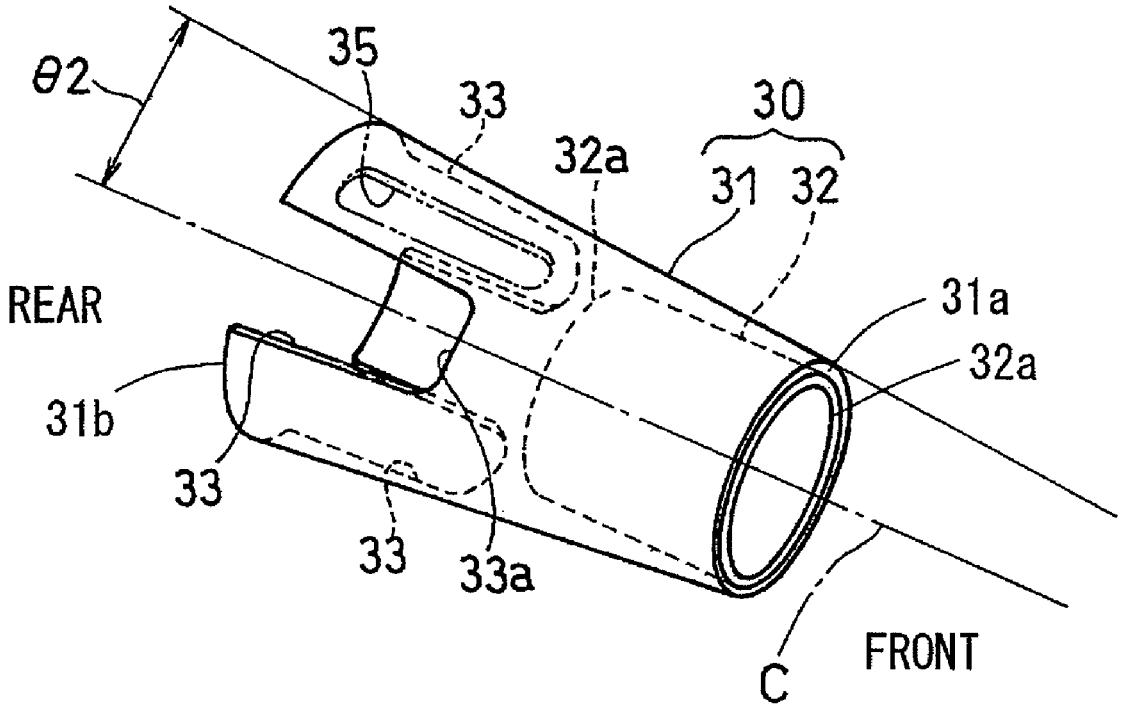
FIG. 4 is a perspective view of the exhaust gas pressure regulating member employed in the exhaust system shown in FIG. 3, as viewed from an upstream side with respect to the direction of flow of exhaust gases from a combustion engine.

The exhaust gas pressure regulating member 30 referred to above is of a structure, in which the tubular inner element 32 of the cylindrical shape having an outer diameter substantially equal to the minimum inner diameter of the tubular outer element 31 is inserted into the tubular outer element 31, which is continuously tapered towards an upstream side, that is, is of a truncated conical shape in the embodiment as shown in FIGS. 3 and 4, and rigidly connected thereto with respective front or upstream ends 31*a* and 32*a* of the tubular outer and inner elements 31 and 32 welded together. As best shown in FIG. 4 showing a perspective view of the exhaust gas pressure regulating member 30 as viewed from the upstream side, the tubular outer element 31 is formed with a plurality of, for example, three, elongated cutouts 33 in the illustrated embodiment, defined therein. The elongated cutouts 33 are substantially equidistantly spaced from each other in a circumferential direction of the tubular outer element 31, each extending from a rear or downstream end of the tubular outer element 31 in a direction towards the upstream side.

Each of the elongated cutouts 33 is formed by an elongated recess having a rear or downstream end open at a downstream end 31*b* of the tubular outer element 31 or the exhaust gas pressure regulating member 30. Each elongated recess or cutout 33 may have a front or upstream end 33*a* terminating at any suitable location flush with the position of a rear or downstream end 32*a* of the tubular inner element 32 on the longitudinal axis C or, alternatively, a distance either downstream or upstream of the rear end 32 of the tubular inner element 32. However, in the illustrated embodiment, the front or upstream end 33*a* of each of the elongated cutouts 33 is set to terminate slightly rearwardly or downwardly of the rear end 32*a* of the tubular inner element 32 as best shown in FIG. 3.

Figure 5:
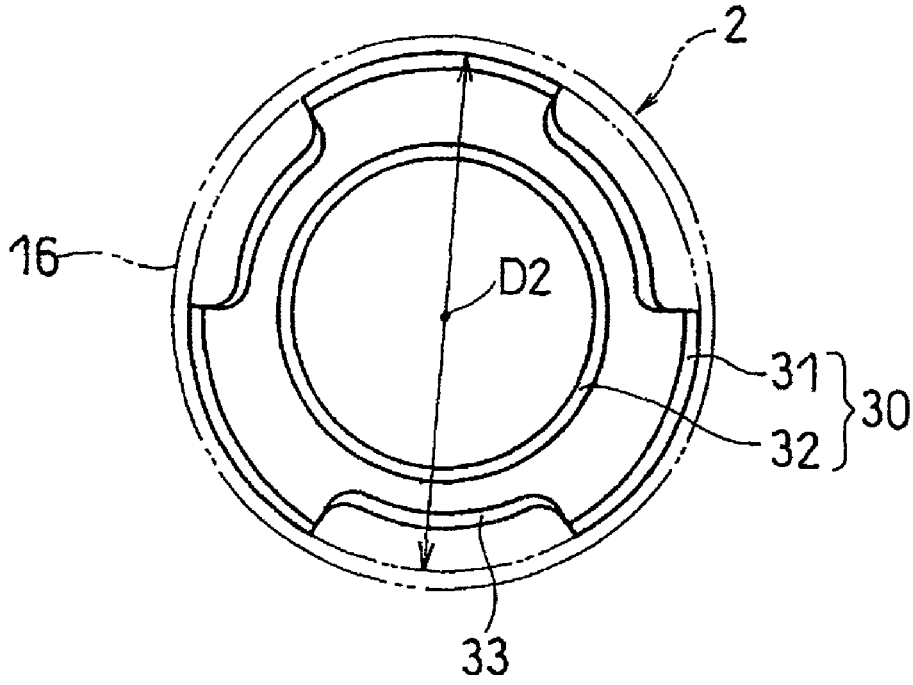
FIG. 5 is a rear end view of the exhaust gas pressure regulating member shown in FIG. 4, as viewed from a downstream side with respect to the direction of flow of exhaust gases from a combustion engine toward the atmosphere.

Thus, the tubular outer and inner elements 31 and 32 are disposed coaxially with each other as shown in FIG. 5. The rear or downstream end portion of the tubular outer element 31 has an outer diameter substantially equal to the inner diameter D2 of the reduced diameter tube portion 16 of the tubular inner shell 2 shown in FIG. 3. Accordingly, the exhaust gas pressure regulating member 30 is disposed inside the tubular inner shell 2 by inserting the rear end portion of the tubular outer element 31 into the reduced diameter tube portion 16 of the tubular inner shell 2 then welding them together.

Even with the exhaust system M according to the second preferred embodiment of the present invention, the tubular inner shell 2 has the non-perforated wall area 22 and, accordingly a sound silencing effect similar to that afforded by the exhaust system M according to the first embodiment of the present invention can be obtained.

In addition, in the exhaust system M according to the second embodiment of the present invention, a portion G1 of the exhaust gases G, which reaches the reduced diameter tube portion 16 in the non-perforated wall area 22 of the tubular inner shell 2, is guided so as to impinge upon the inner peripheral surface of the tubular inner shell 2 while being dispersed radially outwardly along an outer peripheral surface of the tubular outer element 31 that is tapered in a direction upwardly, and to allow the remaining exhaust gases G2 to flow straight through inside the tubular inner element 32. The exhaust gases G2 flowing straight in this manner cause a negative pressure in a region downstream of the rear or downstream end 32*a* of the tubular inner element 32 by an ejector effect. Because of this ejector effect, the exhaust gases G1 flowing outside of the tubular outer element 31 can be introduced inwardly of the tubular outer element 31 through the elongated cutouts 33, that is, into a region downwardly of the downstream end 32*a* of the tubular inner element 32 in an inner passageway 40. Accordingly, in a manner similar to that afforded by the use of the exhaust gas pressure regulating member 19 employed in the first embodiment as shown in FIG. 1, the sound silencing effect can be obtained by causing the exhaust pressure, evolved as the exhaust gases G1 flows through an annular gap between the tubular outer element 31 and the inner peripheral surface of the reduced diameter tube portion 16 in the tubular inner element 2, to change. In reality, owing to the use of the non-perforated wall area 22, not only can the exhaust sounds be reduced by a level of 1 to 1.5 dB, but it has ascertained that the exhaust sounds could be reduced by a level of about 0.5 dB.

The exhaust gases G1 introduced into the annular gap between the tubular outer element 31 and the reduced diameter tube portion 16 are also smoothly introduced into the inner passageway 40 through the elongated cutouts 33 by the effect of a suction force brought about by the ejector effect exhibited by the inside exhaust gases G2 as hereinabove described and, accordingly, the reduction in output of the motorcycle engine can be minimized. In other words, even where this exhaust gas pressure regulating member 30 in accordance with the second embodiment is employed, the exhaust noise can be lowered with the reduction in output of the motorcycle engine suppressed concurrently.

The tubular outer element 31 of the exhaust gas pressure regulating member 30 has a half apex angle θ2, which is set to be preferably within the range of 2 to 15°. Where the half apex angle θ2 is set to be smaller than the lower limit of 2°, the sound silencing effect almost diminishes, and where the half apex angle θ2 exceeds the upper limit of 15°, the flow resistance to the exhaust gases G tends to increase enough to result in reduction of the output of the motorcycle engine.

Also, an axial length of each of the elongated cutouts 33 as measured along the longitudinal axis C of the tubular outer element 31 is set to be preferably within the range of ⅓ to ½ of the axial length of the tubular outer element 31, so that the sound silencing effect resulting from a change in exhaust pressure of the exhaust gases G1 can be secured and, at the same time, the exhaust gases G1 can be smoothly introduced into the inner passageway 40. The number of the elongated cutouts 33 is chosen to be preferably within the range of 2 to 6 and those elongated cutouts 33 may not necessarily be arranged so as to be equidistantly spaced in the circumferential direction of the tubular outer element 31. In addition, the cutout 33 may be formed by a slot 35 defined in the downstream portion of the tubular outer element 31 with no opening at the downstream end 31*a* of the tubular outer element 31 as shown by the phantom lines in FIG. 4 and, even in this case, an effect similar to that described hereinbefore can be obtained.

Figure 6:
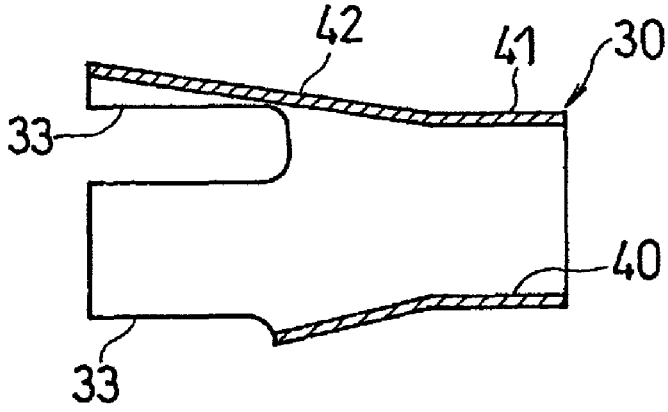
FIG. 6 is a longitudinal sectional view showing the exhaust gas pressure regulating member employed in the exhaust system according to a third preferred embodiment of the present invention.

It is to be noted that the exhaust gas pressure regulating member 30 may be of a structure, in which the tubular outer and inner elements 31 and 32, shown in FIG. 3, are formed integrally with each other. Alternatively, as best shown in FIG. 6, the exhaust gas pressure regulating member 30 may be of a structure, in which a front half thereof is constituted by a straight tube 41 having constant inner and outer diameters in a direction axially thereof and a rear half thereof is constituted by a tapered tube 42 tapered in a direction upstream thereof, with the inner passageway 40 defined inwardly of the straight tube 41.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. For example, the exhaust system M of the present invention can be employed in combination with not only the motorcycle engine referred to hereinbefore, but also any combustion engine employed in, for example, a three-wheeled or four-wheeled automotive vehicle or a portable or ground-mounted engine.

Accordingly, such changes and modifications are, unless they depart from the scope of the present invention as delivered from the claims annexed hereto, to be construed as included therein.

What is claimed is:

1. An exhaust system for a combustion engine, which comprises:

a tubular inner shell for passage therethrough of exhaust gases from the combustion engine, the tubular inner shell having upstream and downstream portions opposite to each other with respect to the direction of flow of the exhaust gases from the combustion engine;

a tubular outer shell enclosing the tubular inner shell and cooperating with the tubular inner shell to define a sound silencing chamber between the tubular inner shell and the tubular outer shell for receiving the exhaust gases therein;

a perforated wall area defined in the upstream portion of the tubular inner shell and having a plurality of communication perforations defined therein for communicating between an interior of the tubular inner shell and the sound silencing chamber;

a non-perforated wall area defined in the downstream portion of the tubular inner shell and having no communicating perforation defined therein, the non-perforated wall area and the perforated wall area being formed on the same tubular inner shell formed by a unitary tube; and an exhaust gas pressure regulating member that is tapered in a direction upstream thereof with respect to the direction of flow of the exhaust gases, the exhaust gas pressure regulating member being fixedly disposed inside the non-perforated wall area of the tubular inner shell;

wherein the sound silencing chamber is positioned radially outwardly of the perforated wall area and the non-perforated wall area and is in fluid communication only with the interior of the tubular inner shell through the communication perforations, and wherein the non-perforated wall area of the tubular inner shell has an axial length with respect to the direction of flow of the exhaust gases, which is equal to or greater than 1.3 times the inner diameter of the non-perforated wall area, and which is within the range of 0.20 to 0.90 times the axial length of the perforated wall area.

2. The exhaust system for the combustion engine as claimed in claim 1, wherein the sound silencing chamber has a sound absorbing material disposed therein.

3. The exhaust system for the combustion engine as claimed in claim 1, wherein the axial length of the non-perforated wall area of the tubular inner shell is within the range of 1.3 to 5 times the inner diameter thereof.

4. The exhaust system for the combustion engine as claimed in claim 1, wherein the exhaust gas pressure regulating member has a substantially conical shape.

5. The exhaust system for the combustion engine as claimed in claim 4, wherein the conical shape of the exhaust gas pressure regulating member has a half apex angle within the range of 3 to 20°.

6. The exhaust system for the combustion engine as claimed in claim 4, wherein the exhaust gas pressure regulating member includes a pair of cone halves, which substantially correspond to respective halves of the shape of a cone divided by a plane including an axis of the exhaust gas pressure regulating member, and which are flanged, the cone halves being connected together at opposite, mutually connected flanges thereof to define the conical exhaust gas pressure regulating member separate from the tubular inner shell with an annular gap defined between the cone halves and an inner peripheral surface of the tubular inner shell and where in the connected flanges are rigidly secured to respective portions of an inner peripheral surface of the tubular inner shell.

7. A motorcycle equipped with the exhaust system for the combustion engine as claimed in claim 1.

8. An exhaust system for a combustion engine, which comprises:

a tubular inner shell for passage therethrough of exhaust gases from the combustion engine, the tubular inner shell having upstream and downstream portions opposite to each other with respect to the direction of flow of the exhaust gases from the combustion engine;

a tubular outer shell enclosing the tubular inner shell and cooperating with the tubular inner shell to define a sound silencing chamber between the tubular inner shell and the tubular outer shell for receiving the exhaust gases therein;

a perforated wall area defined in the upstream portion of the tubular inner shell and having a plurality of communication perforations defined therein for communicating between an interior of the tubular inner shell and the sound silencing chamber;

a non-perforated wall area defined in the downstream portion of the same tubular inner shell and having no communicating perforation defined therein, wherein the sound silencing chamber is positioned radially outwardly of the perforated wall area and the non-perforated wall area and is in fluid communication only with the interior of the tubular inner shell through the communication perforations, and an exhaust gas pressure regulating member that is tapered in a direction upstream thereof with respect to the direction of flow of the exhaust gases, the exhaust gas pressure regulating member being a member separate from the tubular inner shell and fixedly disposed inside the non-perforated wall area of the tubular inner shell and includes a pair of cone halves, which substantially correspond to respective halves of the shape of a cone divided by a plane including an axis of the exhaust gas pressure regulating member, and which are flanged, the cone halves being connected together at opposite, mutually connected flanges thereof to define the conical exhaust gas pressure regulating member and where in the connected flanges are rigidly secured to respective portions of an inner peripheral surface of the tubular inner shell with an annular gap defined between the cone halves and an adjacent inner peripheral surface of the tubular inner shell.

9. The exhaust system for the combustion engine as claimed in claim 8 wherein the non-perforated wall area of the tubular inner shell has an axial length with respect to the direction of flow of the exhaust gases, which is equal to or greater than 1.3 times the inner diameter of the non-perforated wall area, and which is within the range of 0.20 to 0.90 times the axial length of the perforated wall area.

10. The exhaust system for the combustion engine as claimed in claim 8, wherein the sound silencing chamber has a sound absorbing material disposed therein.

11. The exhaust system for the combustion engine as claimed in claim 8, wherein the axial length of the non-perforated wall area of the tubular inner shell is within the range of 1.3 to 5 times the inner diameter thereof.

12. The exhaust system for the combustion engine as claimed in claim 8, wherein the conical shape of the exhaust gas pressure regulating member has a half apex angle within the range of 3 to 20.

13. A motorcycle equipped with the exhaust system for the combustion engine as claimed in claim 8.

14. The exhaust system for the combustion engine as claimed in claim 8 wherein the cone halves are formed in a central location on a pair of flat plates that each form a flat surface for each flange to encircle the respective cone halves and divide the exhaust gases in the non-perforated wall area to flow through respective annular gaps between the respective cone halves and adjacent non-perforated wall area of the tubular inner shell to suppress exhaust pressure turbulence and provide a low resistance to the output flow of the exhaust gases.

* * * * *